United States Patent [19]

Drummond et al.

[11] Patent Number: 4,508,183

[45] Date of Patent: Apr. 2, 1985

[54] METHOD AND APPARATUS FOR LUBRICATING A DRILL BIT

[75] Inventors: Donald D. Drummond, Jasper; Walter F. Johnsey; Roy W. Wood, both of Birmingham, all of Ala.

[73] Assignee: Drumco, Birmingham, Ala.

[21] Appl. No.: 482,907

[22] Filed: Apr. 7, 1983

[51] Int. Cl.[3] ..... E21B 21/14

[52] U.S. Cl. ..... 175/69; 175/215; 175/337

[58] Field of Search ..... 175/69, 337, 339, 340, 175/422, 215, 227-229; 166/88, 75 R; 285/94; 184/6

[56] References Cited

U.S. PATENT DOCUMENTS

| | | | |
|---|---|---|---|
| 1,474,633 | 11/1923 | Hughes | 175/227 |
| 3,037,264 | 6/1962 | Mossberg | 29/106 |
| 3,198,267 | 8/1965 | Madson | 175/69 |
| 3,199,382 | 8/1965 | Andreasson | 77/72 |
| 3,244,256 | 4/1966 | Fath et al. | 184/6 |
| 3,359,837 | 12/1967 | Andreasson | 77/68 |
| 3,370,480 | 2/1968 | Andreasson | 77/72 |
| 3,511,120 | 5/1970 | Kaser | 77/68 |
| 3,543,613 | 12/1970 | Obloy | 77/72 |
| 3,561,299 | 2/1971 | Brisk et al. | 77/55 |
| 3,597,817 | 8/1971 | Whalley | 29/106 |
| 3,798,725 | 3/1974 | Hanson | 29/106 |
| 3,924,695 | 12/1975 | Kennedy | 175/69 |
| 4,080,091 | 3/1978 | Hollingshead | 408/60 |
| 4,168,925 | 9/1979 | Dufresne | 408/59 |
| 4,187,920 | 2/1980 | Johnson | 175/337 X |

*Primary Examiner*—Stephen J. Novosad
*Assistant Examiner*—Thuy M. Bui
*Attorney, Agent, or Firm*—Dann, Dorfman, Herrell and Skillman

[57] ABSTRACT

A method and apparatus for providing a flow of lubricating fluid from a surface-mounted lubricating fluid source through a rotatable drill pipe to rotary cutting cones of a rotary drill bit for drilling in an underground formation, including pump means for providing a flow of lubricating fluid from the fluid source to an end of the drill pipe. Drill pipe conduit means extending along the length of the drill pipe is provided for receiving the flow of lubricating fluid and for directing the lubricating fluid flow along the drill pipe to the drill bit. Distribution conduit means at the drill bit extends from the drill pipe conduit means to the cutting cones and receives the flow of lubricating fluid from the drill pipe conduit means for directing the lubricating fluid flow to the cutting cones for lubrication thereof.

18 Claims, 8 Drawing Figures

METHOD AND APPARATUS FOR LUBRICATING A DRILL BIT

BACKGROUND OF THE INVENTION

The present invention relates generally to a method and apparatus for lubricating rotary drill bits during a drilling operation and, more particularly, to such a method and apparatus for lubricating the bearings of such a drill bit having a plurality of bearing-mounted rotary cutting cones.

DESCRIPTION OF THE PRIOR ART

The present application relates generally to our co-pending U.S. patent application Ser. No. 435,239, filed Oct. 19, 1982, entitled "Drill Bit Assembly", which is incorporated herein by reference. The aforesaid patent application describes in detail and claims a drill bit assembly with preferably multiple cutting cones for drilling into a relatively hard material, such as rock and the like. As was pointed out in the aforesaid application, typical prior art rotary bits used for drilling into such relatively hard materials generally comprise an elongated tubular housing or adapter sub to which is attached a "bit", which includes a plurality (generally three) of bearing-mounted rotary cutting cones on the lower end thereof. The upper end of the adapter sub is adapted to be coupled to a rotary drill, either directly or through the use of a suitable drill pipe extension when drilling deep holes. The adapter sub includes a central conduit which extends from the rotary drill (or the extension drill pipe) to the drill bit, which has a mating conduit extending to the vicinity of the cutting cones. Pressurized air from the rotary drill flows through the central conduit of the adapter sub and is discharged at the drill bit through nozzles positioned between the cutting cones for impingement upon the rock or other material being drilled, the air acting as a scavenging medium to pick up dust and cuttings and carry them upwardly out of the drill hole. Water or other such wetting agents are often added to the airflow to help control the dust generated by the drilling operation.

Our co-pending patent application describes and claims a drill bit assembly which overcomes or substantially diminishes the drawbacks associated with the prior art drill bits and provides for an improved, longer service life drill bit by dividing the airflow in the drill bit assembly into three portions. The first downwardly directed flow of air picks up and removes dust and cuttings from the vicinity of the cutting cones, the second upwardly directed flow of air serves to scavenge the dust and cuttings away from the drill bit assembly and out of the drill hole and the third flow of air is employed to convey lubricating fluid or oil to the cutting cone bearings to both cool and lubricate the bearings. The lubricating fluid is stored within a cylindrical reservoir within the housing of the drill bit assembly (particularly the adapter sub) and is distributed to the cutting cone bearings at a controlled flow rate.

While the lubrication system described and claimed in our co-pending patent application has achieved success in improving the service life of the cutting cone bearings of the drill bit, that lubrication system may prove to be somewhat inconvenient during certain operational applications due to the limited size of the fluid reservoir within the adapter sub of the drill bit assembly. More specifically, the lubricating fluid reservoir disclosed in our co-pending application must be periodically refilled in order to provide the relatively continuous flow of lubricating fluid necessary to cool and lubricate the cutting cone bearings for longer service life. In order to refill the lubricating fluid reservoir within the drill bit assembly, the drilling operation must be stopped and the drill bit assembly must be temporarily withdrawn from the drill hole. If the drill hole is substantial in length, the periodic interruption of the drilling process for refilling the reservoir can result in a substantial time delay, which is not cost effective for the drilling operation.

The present invention provides a method and apparatus for a continuous flow of lubricating fluid to the cutting cone bearings to lubricate and cool the bearings without interruption of the drilling operation.

SUMMARY OF THE INVENTION

Briefly stated, the present invention involves a method and apparatus for providing a flow of lubricating fluid from a surface-mounted lubricating fluid source through a rotatable drill pipe to the rotary cutting cones of a rotary drill bit used in drilling in an underground formation. Pump means provides a flow of lubricating fluid from the lubricating fluid source to the drill pipe. Drill pipe conduit means extends along the drill pipe for receiving the flow of lubricating fluid and for directing the lubricating fluid flow to the drill bit. Distribution conduit means extends from the drill pipe conduit means to the cutting cones for receiving the flow of lubricating fluid from the drill pipe conduit means and directing the lubricating fluid flow to the cutting cones for the lubrication thereof.

BRIEF DESCRIPTION OF THE DRAWINGS

The foregoing summary, as well as the following detailed description of a preferred and an alternate embodiment of the present invention, will be better understood when read in conjunction with the accompanying drawings, in which.

DESCRIPTION OF A PREFERRED EMBODIMENT

Figure 1:
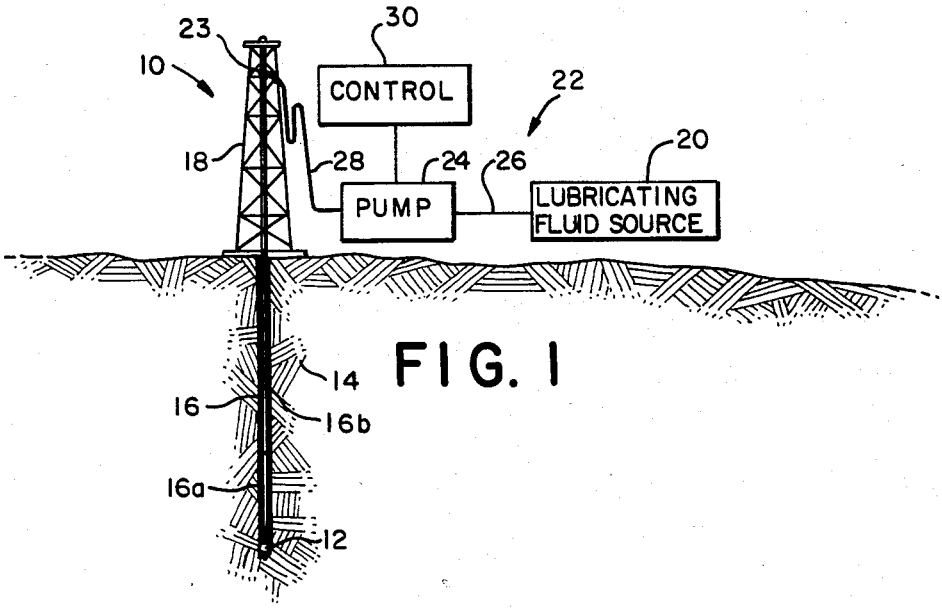
FIG. 1 is a schematic view of the apparatus for providing a flow of lubricating fluid to the drill bit assembly of the present invention shown in use in an underground formation.

Referring to the drawings, and particularly to FIG. 1, there is shown a schematic illustration of an apparatus, generally designated 10, for providing a flow of lubricating fluid to a drill bit assembly 12 in accordance with the present invention. The drill bit assembly 12 is of the type used in conjunction with a standard rotary drill or pipe drive mechanism (not shown in detail) for drilling into an underground formation 14 of relatively hard material, such as rock or the like. The drill bit assembly 12, which will be hereinafter described in greater detail, may be supported in the underground formation 14 by a rotatable drill pipe 16, which may comprise a plurality of individual drill pipe sections (16*a*, 16*b*, etc.) of a standard or uniform length or of various lengths which are coupled together in end-to-end relationship in accordance with techniques well known in the art to form a generally continuous drill pipe of a length sufficient to drill or bore a hole of necessary or desired depth. A surface-mounted drilling rig or derrick 18 is employed during the drilling operation to support the drill pipe 16 and the rotary drill (not shown) in a manner well known in the art. Alternatively, a portable drill rig, such as a truck mounted drill rig (not shown) may be employed to support the drill pipe 16 and drill bit assembly 12.

The apparatus 10 is employed to provide a flow of lubricating fluid from a surface-mounted lubricating fluid source 20 to the rotary cutting cones (not shown on FIG. 1) of the drill bit assembly 12 during the drilling operation. The lubricating fluid which is provided to the drill bit cutting cones may be a standard fluid lubricant or oil of a suitable type well known in the drilling art and the lubricating fluid source 20 may comprise any suitable storage facility containing a desired quantity of such lubricant or oil, such as, for example, a 50-gallon drum which may be conveniently replaced or refilled as needed.

Pump means, shown generally as 22, is employed for providing a flow of lubricant from the lubricating fluid source 20 to an oiling gland adapter 23 (not shown in detail in FIG. 1) located at or along the exposed portion of the drill pipe 16 for subsequent delivery to the drill bit assembly 12 in a manner described more fully hereinafter. In accordance with the present invention, the pump means 22 may comprise a standard pneumatic positive displacement pump 24 of a type well known in the art or any other suitable pump, a first lubricant conduit means or intake pipe 26 for connecting the lubricating fluid source 20 to the intake side of the pump 24 and a second lubricant conduit means or supply pipe 28 for providing fluid communication between the output side of the pump 24 and the oiling gland adapter 23 located at the upper end of the drill pipe 16. The supply pipe 28 is provided preferably by a flexible pipe with excess length or a loop, as shown in FIG. 1, in order to be able to travel up and down with the pipe drive mechanism (not shown) during the drilling operation. In this arrangement, the pump 24 is employed during the drilling operation to provide a flow of lubricant or oil from the lubricating fluid source 20 into the upper end of the drill pipe 16 for delivery to the drill bit assembly 12.

The pump means 22 further includes a control means 30 for controlling the operation of the pump 24. In the present embodiment, the control means 30 preferably comprises a timer for cycling the pump 24 on and off at predetermined time intervals. For example, the timer 30 may cause the pump 24 to operate 30 seconds out of every minute in order to provide a 30-second flow of lubricating fluid to the upper end of the drill pipe 16 every minute. The timer 30 may also be adjustable to vary the predetermined on and off time intervals depending upon the characteristics of the drill bit assembly 12, and/or the type of the underground formation in which the drill is being operated. For example, if the underground formation is particularly hard, such as, for example, granite-type rock, it may be desirable to provide a flow of lubricating fluid at more frequent intervals or even continuously. Alternatively, if the underground formation is relatively soft, such as, for example, certain types of sedimentary rock, the flow of lubricating fluid may be provided less frequently such as, for example, one 30-second flow of lubricating fluid every three to five minutes. Timers having operating characteristics of the type described above, which are well known in the art, may be either electrically or mechanically operated and may be conveniently purchased commercially from a variety of different manufacturers.

Figure 3:
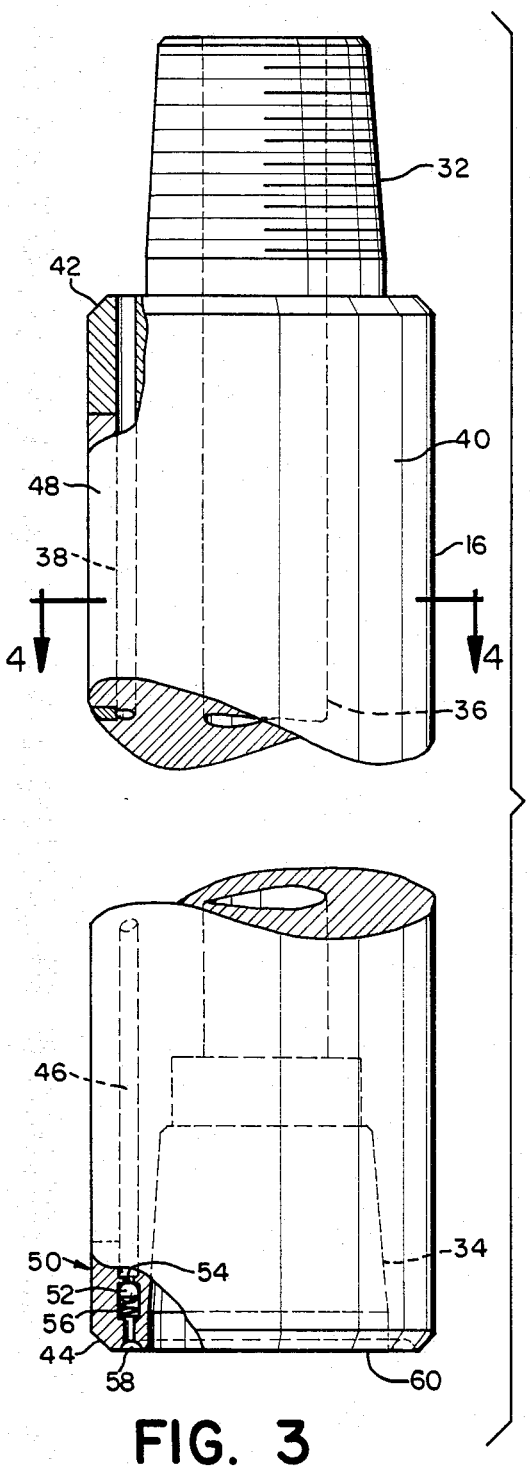
FIG. 3 is an enlarged fragmentary elevation view, partially in section and partially broken away, of the drill pipe portion of the apparatus of FIG. 1.
Figure 4:
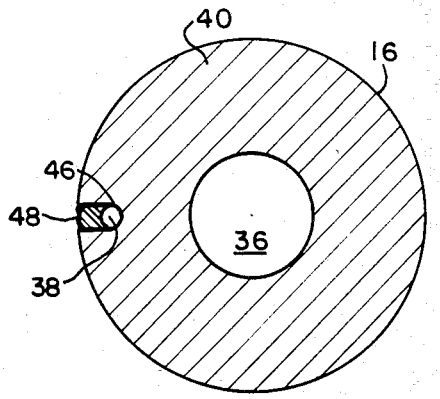
FIG. 4 is a sectional view of a portion of the drill pipe of FIG. 3 taken along section line 4—4 of FIG. 3.

Referring now to FIGS. 3 and 4, detailed views of a section of the drill pipe 16 are shown. The drill pipe 16 preferably comprises a standard drill pipe employed in the art but with certain modifications hereinafter to be described. Each section of the drill pipe may be of any standard length, such as, 20 feet and includes a standard frustoconically-shaped threaded nipple portion 32 on one end and a complimentary sized and shaped threaded socket portion 34 within the other end to permit a plurality of such drill pipe sections to be conveniently joined together in an end-to-end relationship to form a continuous drill pipe of a desired length for a particular drilling operation. The drill pipe 16 includes a central generally cylindrical conduit 36 extending along the length thereof from end to end as shown in FIG. 3. During the drill operation, the conduit 36 receives pressurized fluid or air from a source of air under pressure (not shown), which is maintained or located near the upper end of the drill pipe 16. The pressurized air passes through the conduit 36 and is provided to the drill bit assembly 12 for purposes which will hereinafter be described. The use of such air source with the drill pipe is well known in the art.

In order to provide a means for the lubricant from the lubricating fluid source 20 to flow from the upper end of the drill pipe 16 to the drill bit assembly 12, a galley line or drill pipe conduit means 38 is included within the wall 40 of the drill pipe 16 of each section of the drill pipe. The galley line extends from the upper end 42 to the lower end 44 of each drill pipe. In the present embodiment as shown on FIGS. 3 and 4, the galley line 38 is formed by casting or machining a keyway or slot 46 along most of the length of the drill pipe section as shown. Thereafter, a suitably sized elongated cover member 48 is fixed welded in place along the surface of the drill pipe wall 40 to fill in a portion of the slot 46 and to turn the slot 46 into an enclosed conduit as shown. The outer surface of the cover member 48 is suitably curved to conform to the curvature of the drill pipe in order to provide a generally continuous smooth outer surface once the cover member 48 is installed within the slot 46. The inner surface of the cover member 48 may also be suitably curved as shown in FIG. 4 to provide the galley line 38 with a generally smooth inner surface.

In the present embodiment, the upper and lower six inches of the galley line 38 is preferably formed by drilling a suitably sized hole within the drill pipe wall 40, as indicated in FIG. 3. In this manner, the galley line 38 may be provided without significantly affecting the structural integrity of the pipe wall 40.

In order to prevent the inadvertent leakage or drainage of lubricant or oil from the galley line 38 when a section of drill pipe 16 is not connected to the drill bit assembly 12 or when the drilling apparatus is not in operation, the galley line 38 in each pipe section further includes a check valve 50 at one end thereof, and in the present embodiment shown at the bottom end. The check valve 50 may be of any suitable type known in the art. In the present embodiment, the check valve 50 comprises a ball 52 which is urged upwardly against a suitably sized and shaped seat 54 by the force of a compression spring 56. The compression spring 56 is strong enough to urge the ball 52 into full engagement against the seat to block off the downward leakage flow of lubricant through the galley line 38 during periods of time when the lubricant in the galley line is not under pressure. The spring 56 will allow the ball 52 to disengage the seat 54 upon sufficient pumping pressure of the lubricant line.

The galley line 38 further includes an annular distribution groove 58 cut within lower facing surface 60 of the drill pipe 16. In the present embodiment, the annular distribution groove 58 is cut in the lower end 44 of the drill pipe 16 just below the check valve 50. The annular distribution groove 58 is provided to permit the lubricant to flow around the end of the drill pipe 16 to facilitate the flow of lubricant between interconnected drill pipe sections without having to be concerned with direct alignment of the galley line 38 in each drill pipe section. In this manner, the galley line 38 may be conveniently extended along the entire length of the drill pipe no matter how many pipe sections are employed for a particular drilling operation.

Figure 2:
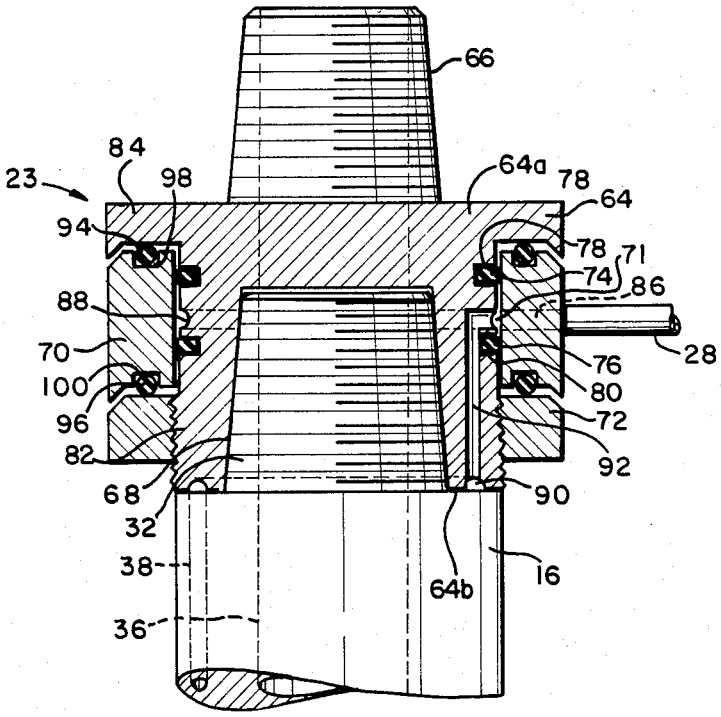
FIG. 2 is an enlarged view, partially in section, of the oiling gland adapter portion of the apparatus of FIG. 1.

Referring now to FIG. 2, there is shown the details of an oiling gland adapter means 23. The oiling gland adapter means is preferably provided at or along the upper or pipe drive head end of the drill pipe 16. Alternatively, the oiling gland adapter means 23 may be incorporated into and may comprise a part of the floating drive head (not shown). The oil gland adapter means receives the flow of lubricant from the pump 24 and directs the lubricant into the galley line 38 of the drill pipe 16, which is adapted to rotate during the drilling operation.

The oiling gland adapter means 23 includes a generally annular or cylindrical adapter housing 64 having a standard, frustoconically-shaped threaded nipple portion 66 on one end 64*a*, (the upper end as shown on FIG. 2) for engaging a complimentary sized and shaped socket portion (not shown) of a pipe drive head (not shown), a rotary drill (not shown) or other suitable driving connection.

Correspondingly, the other end 64*b* (the lower end as shown on FIG. 2) of the oil gland adapter housing 64 includes a frustoconically-shaped threaded socket portion 68 for engaging a complimentary sized and shaped nipple 32 of drill pipe 16 for interconnecting the oiling gland adapter housing 64 with the drill pipe 16. The oiling gland adapter means 23 further includes an annular cylindrical slip ring member 70 which generally surrounds and is spaced slightly apart from a portion of the oiling gland adapter housing 64 to provide an annular cavity 71 for oil therebetween. The slip ring member 70 is retained in position with respect to the oiling gland adapter housing by an annular retaining nut 72 and a pair of annular steel piston rings 74 and 76. The piston rings 74 and 76 are installed within suitable annular grooves 78 and 80 around a portion of the the oiling gland adapter housing 64 and function to maintain the proper radial clearance between the rotating oiling gland adapter housing 64 and the non-rotating or relatively stationary slip ring member 70. The annular retaining nut 72 cooperates with suitable threading 82 on the oiling gland adapter housing 64 to hold the slip ring in fixed relation to a radially outwardly extending annular shoulder 84 on the upper end 64*a* of the oiling gland adapter housing 64 to maintain the axial position of the slip ring member 70 relative to the oiling gland adapter housing 64.

The supply pipe 28 from the lubricant pump 24 is attached to the slip ring member 70, as shown in FIG. 2. A suitable cylindrical opening or conduit 86 is provided radially through the slip ring member 70 to permit fluid communication between the lubricant supply pipe 28 and the annular oil cavity 71 formed between the slip ring member 70 and the oiling gland adapter housing 64.

A recess or notch 88 is provided around the circumference of the oiling gland adapter housing 64 as part of the annular oil cavity 71 shown in FIG. 2. The notch 88 is provided to receive at least part of the flow of lubricant from the slip ring member conduit 86. An annular notch or distribution groove 90 is also provided in the lower surface 64*b* of the oiling gland adapter housing 64. The annular distribution groove 90 is of an appropriate radial diameter so as to communicate with the galley line 38 in the drill pipe 16 when a drill pipe 16 and the oiling gland adapter housing 64 are coupled together, so that the galley line 38 is assured of communication with the distribution groove 90 without having to be concerned with any direct alignment of oil lines. A suitable connecting conduit of line 92 extends between the annular oil cavity 71 and the annular distribution groove 90 to provide fluid communication therebetween. The steel rings 74 and 76, as well as a pair of O-rings 94 and 96 positioned within suitable annular notches 98 and 100 within the upper and lower surfaces of the sling ring member, cooperate to prevent the lubricant from flowing out of the space between the oiling gland adapter housing 64 and the slip ring member 70.

During the drilling operation, the drill pipe 16 and the oiling gland adapter housing 64 rotate together in the arrangement for providing rotational action to the drill bit assembly 12. The slip ring member 70 remains stationary relative to the rotating parts. Lubricant from the lubricating fluid source 20 is pumped by pump 24 through the supply pipe 28 and the slip ring conduit 86 and enters the annular cavity 71 between the rotating oiling gland adapter housing 64 and the slip ring member 70. The oil flows circumferentially around the oil cavity 71, including notch 88, in the oiling gland adapter housing and passes downwardly through the connecting conduit 92 into the annular distribution groove 90. Once the lubricant enters the annular distribution groove 90, it flows around the groove 90 and enters the galley line 38 for flowing downwardly through the drill pipe. Thereafter, the lubricant passes from drill pipe section to drill pipe section along the entire length of the drill pipe 16 until it reaches the drill bit assembly 12.

Figure 5:
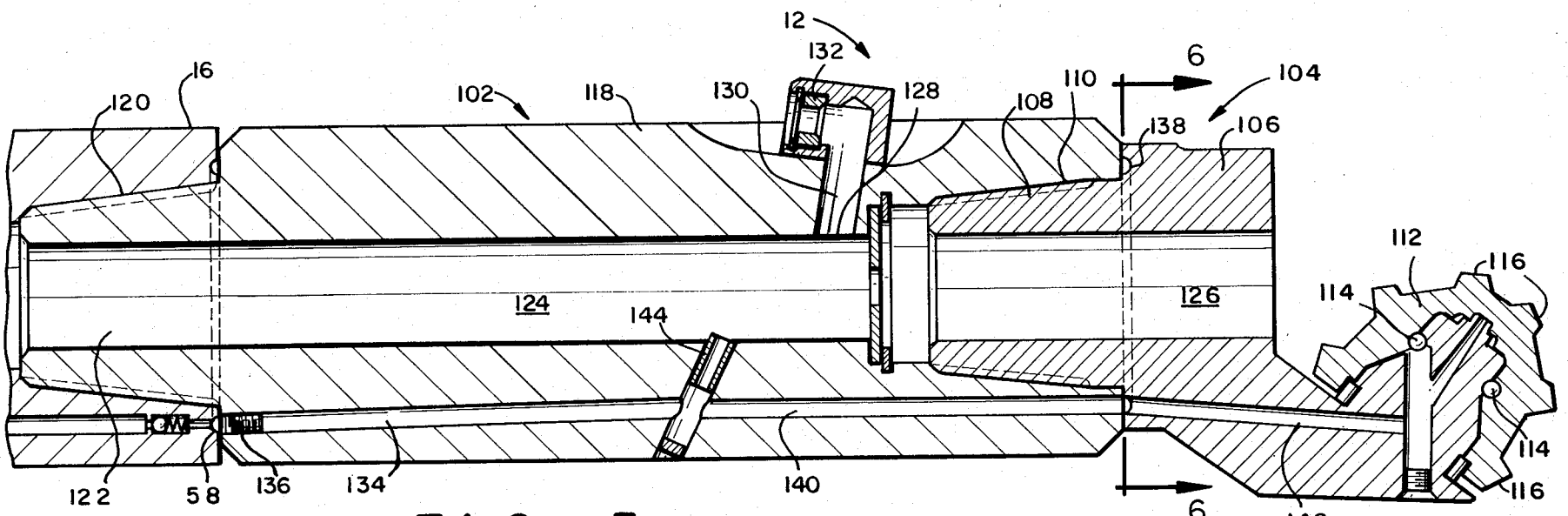
FIG. 5 is an enlarged sectional view of the drill bit assembly portion of the apparatus of FIG. 1.

Referring now to FIG. 5, there is shown a sectional view of the drill bit assembly 12. A detailed descripton of the structure and operation of a related drill bit assembly, which has the lubrication fluid source for the drill bit in the adapter sub, is provided in our aforementioned co-pending patent application, which is incorporated herein by reference. Basically, in FIG. 5, the drill bit assembly 12 is generally comprised of two major assemblies; an adapter subassembly or adapter sub 102 and a drill bit 104, as previously noted, the lubrication fluid source being surface mounted.

The drill bit 104 comprises an irregularly shaped housing 106 having a frustoconically-shaped threaded nipple 108 at one end for engaging a complimentary sized and shaped tapered threaded socket 110 of the adapter sub 102 to secure the two assemblies together, as shown in FIG. 5. The drill bit housing 106 is adapted to support three rotary cutters or cutting cones 112 (only one of which is shown in FIG. 5 for purposes of clarity). Each of the cutting cones 112 is journalled for independent rotation by bearings 114 which, in the present embodiment, comprise suitable anti-friction bearings. The exterior surface of each of the cutting cones 112 includes a plurality of cutting teeth 116 which are employed for cutting into rock and other hard materials upon rotation of the drill bit assembly 12 during the drilling operation.

The adapter sub 102 comprises a generally cylindrically-shaped elongated housing 118 having a frustoconically-shaped threaded nipple portion 120 at the end remote from the drill bit 104 for engagement with the drill pipe 16. The adapter sub housing 118 also includes a generally cylindrically axial bore or passageway 122, which extends longitudinally through the center of the housing 118 from end to end. During the drilling operation, the bore 122 receives pressurized fluid or air from the central conduit 36 within the drill pipe 16. The pressurized air enters a plenum chamber 124 within the passageway 122. The air flowing through plenum chamber 124 is divided into three primary flows, in a manner similar to that described in the aforementioned co-pending patent application. A first flow of pressurized air is directed downwardly from the chamber 124 (toward the right on FIG. 5) through a restriction into a drill bit conduit 126 and is discharged therefrom between the cutting cones 112 for impingement upon the material being drilled. The purpose of the first air flow is to cool the surface of the cutting cones 112 and to serve as a circulating medium to pick up and exhaust or remove dust and material cuttings from the drill hole in the vicinity of the cutting cones 112. The force of the first air flow serves to convey the cuttings and dust upwardly past the cutting cones 112 and around the outer surface of the drill bit assembly 12.

The second flow of pressurized air from chamber 124 is directed through three generally circular openings 128 disposed generally equidistantly from each other around the circumference of the plenum chamber 124 (only one of which is shown on FIG. 5). The openings 128 extend radially outwardly and slightly downwardly (to the right in FIG. 5) through the adapter sub housing 118 to form generally cylindrical conduits 130. The conduits 130 provide fluid or air communication between the plenum chamber 124 and three corresponding jet nozzle assemblies 132. The jet nozzle assemblies 132 (only one nozzle assembly is shown on FIG. 5 for clarity) are mounted on the outer surface of the adapter sub housing 118 and are oriented with their nozzle orifices pointing toward the upper end of the drill bit assembly 12 (toward the left as viewed in FIG. 5) to direct air upwardly. During the drilling operation, air from the plenum chamber 124 is directed through the conduits 130 and out of jet nozzle assemblies 132 toward the upper end of the drill bit assembly 12 as a scavenging flow of air to pick up or combine with the above-described first air flow for further conveying the dust and cuttings removed from the vicinity of the cutting cones upwardly and out of the drill hole.

The third flow of pressurized air from the plenum chamber 124 is mixed with the incoming lubricant in a manner as described hereinafter. As previously mentioned, the lubricant flows through the galley line 38 in the various sections of the drill pipe 16 until the lubricant flow reaches the annular distribution groove 58 on the section of drill pipe 16 which is coupled to the drill bit assembly 12, as shown in FIG. 5. Thereafter, lubricant flows around the annular distribution groove 58 and into three adapter sub distribution conduits 134 (only one of which are shown on FIG. 5), which are generally equally spaced around the adapter sub housing 118 and extend generally axially therethrough as shown. Each conduit 134 extends generally axially along the adapter sub housing 118 until it intersects with a second conduit means 140, where the lubricant is mixed with a third flow of pressurized air in a manner which will hereinafter become apparent. A metering means, for example, a flow restricter 136, may be placed within each conduit 134 in order to provide a controlled flow of lubricant into the adapter sub housing 118. The restriction 136 may be variable in size to provide for differeing lubricant flows depending upon operating conditions of the drill bit assembly 12.

Figure 6:
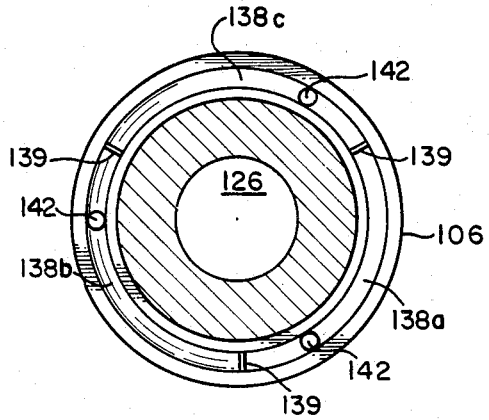
FIG. 6 is a sectional view of the drill bit assembly of FIG. 5 taken along section line 6—6 of FIG. 5.

Upon reaching the lower end of the adapter sub housing 118 (the right end as viewed on FIG. 5), the air and lubricant enters an annular conduit or groove 138, which is formed in the drill bit housing 106 to provide a lubricant reservoir between the adapter sub and drill bit. The groove or lubricant reservoir 138 is divided by suitable partition means 139 (as shown in FIG. 6) into three arcuate reservoir segments **138*a*, 138*b* and 138*c*. Each of the reservoir segments 138*a*, 138*b*, and 138*c* provides an individual supply of lubricant and air for each of the individual cutting cones 112**.

A generally cylindrical distribution conduit 142 in the drill bit housing 106 is provided for fluid communication between the reservoir segment **138*a* and the cutting cone bearings 114, so that the lubricant and air mixture may flow from the reservoir 138*a*, through the drill bit distribution conduit 142 and into contact with the cutting cone bearings 114 for lubrication and cooling thereof. A different drill bit distribution conduit, such as distribution conduit 142 as shown in FIG. 5, is generally in registry with conduit means 140 by means of one of the reservoir segments 138*a*, 138*b* or 138*c*, to provide lubrication to each of the three cutting cones, such as shown for cutting cone 112 in FIG. 5**.

During the drilling operation, it is sometimes necessary to insert water or some other wetting agent into the air flowing passing through the drill pipe 16 and into the plenum chamber 124, and hence through the drill bit for controlling the dust generated during the drilling operation. The insertion of water into the lubricant and air stream passing through the drill bit via conduit 142 may cause corrosion or premature wear of the cutting cone bearings 114. As shown on FIG. 5, air from the plenum chamber 124 enters the conduit means 140 through a deflector port 144, which is positioned and oriented in such a manner that the flow of air must undergo a 110° change of direction prior to entry into port 144. Thus, the air from chamber 124 must change flow direction before entering the conduit 140 at the entry port 144. In this manner, any water or other wetting agent in the air is effectively separated from the air when the air changes flow direction to mix with the lubricant and enter conduit 140. Thus, the lubricant and air mixture flowing through the conduit 140 for the eventual cooling and lubrication of the cutting cone bearings 114 remains relatively free of moisture despite the addition of water to the pressurized air flowing through the center of the drill pipe. It should also be apparent that the pressurized air entering port 144 prevents oil from flowing out air entry port 144 into the plenum chamber 124.

ALTERNATE EMBODIMENT

Figure 7:
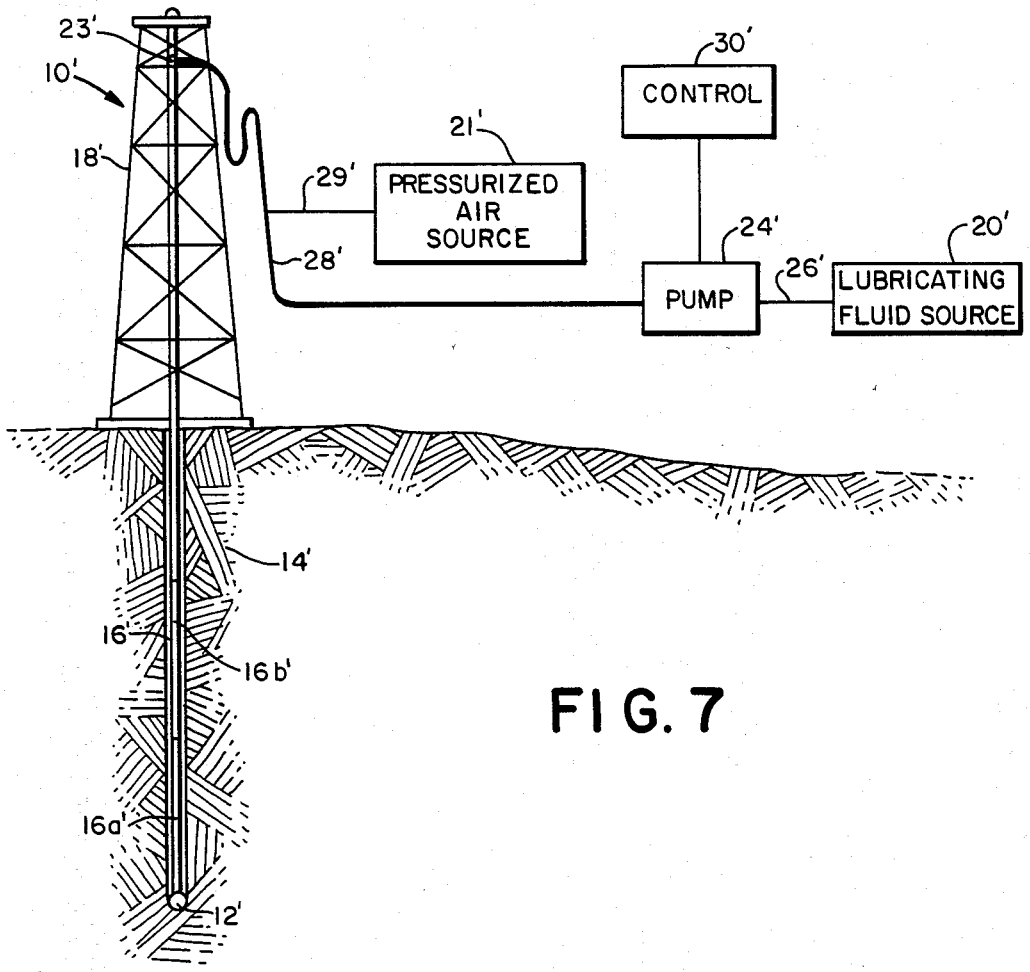
FIG. 7 is a schematic view of an alternate embodiment of the present invention similar to FIG. 1 but showing the mixing of pressurized air with the lubricant prior to introduction into the drill pipe.
Figure 8:
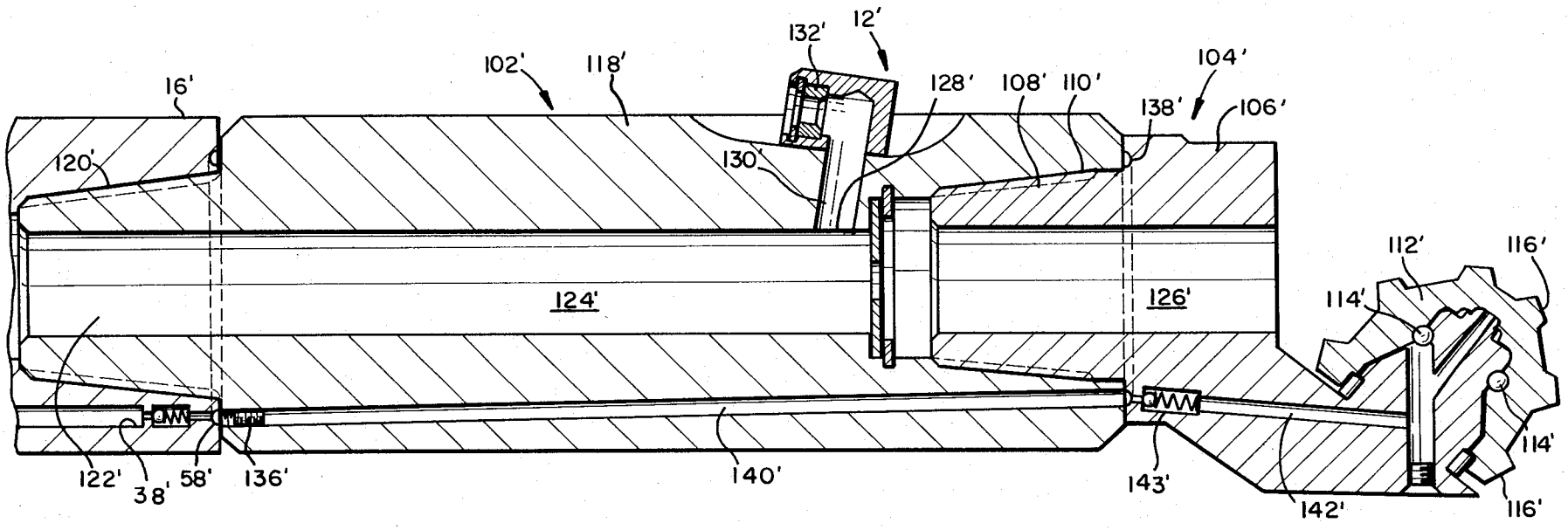
FIG. 8 is an enlarged sectional view of the drill bit assembly portion of the apparatus of FIG. 7.

Referring now to FIGS. 7 and 8, there is shown an alternate embodiment of the present invention. The alternate embodiment, as shown on FIGS. 7 and 8, is substantially the same structure as the above-described embodiment with the exception of certain below-described modifications which permit the mixing of pressurized air with the lubricant prior to the introduction of the lubricant into the lubricant galley line or conduit means in the drill pipe. In this manner, the lubricant and air are mixed on the surface, rather than being mixed underground within the adapter sub as described above. In order to facilitate the reading and understanding of the description of the alternate embodiment, the reference numerals used to identify the various components will be the same as those used to identify the equivalent component in the above-described embodiment but with the addition of primes (′) thereto. Furthermore, in view of the detailed description previously provided, components which are the same or substantially the same as those described above will not be described in detail again hereinafter.

Referring now to FIG. 7, there is shown a schematic illustration of the alternate embodiment of the apparatus generally designated 10′ for providing a flow of lubricating fluid and pressurized air to a drill bit assembly 12′ supported in an underground formation 14′ by a surface-mounted derrick 18′ and a rotatable drill pipe 16′. As in the above-described embodiment, pump means 24′ is employed for providing a flow of lubricant from a lubricating fluid source 20′ to an oiling gland adapter 23′ through a supply pipe 28′. However, unlike the above-described embodiment, the present embodiment further includes a pressurized air source 21′, for example, an air compressor, which is connected via a suitable connecting conduit or pipe 29′ to the supply pipe 28′. In this manner, the pressurized air from the pressurized air source 21′ is introduced into the oiling gland adapter 23′ along with the lubricant. Thereafter, the mixture of air and lubricant flows down through the various sections (**16*a*′, 16*b*′, etc.) of the drill pipe 16′** through its galley line in the same manner as is set forth in detail in connection with the above-described embodiment for the lubricant alone.

Referring now to FIG. 8, there is shown a sectional view of the drill bit assembly 12′ of the alternate embodiment of the present invention. As with the above-described drill bit assembly, drill bit assembly 12′ is generally comprised of two major assemblies; an adapter sub assembly or adapter sub 102′ and a drill bit 104′. The drill bit 104′ is substantially the same as the above-described drill bit 104 except that each of the three distribution conduits 142′ (only one of which is shown) within the drill bit housing 106′ includes an additional check valve 143′ (only one of which is shown) which is not present in the above-described embodiment. In addition, the three equally spaced connecting conduits 140′ (only one of which is shown) extend directly between the flow restrictors 136′ (only one of which is shown) and the annular conduit or groove 138′ and the air entry port 144 in FIG. 5 is eliminated. In the arrangement of FIG. 8, the lubricant and air mixture flowing down the drill pipe galley line 38′ passes through the flow restrictor 136′ directly along the connecting conduits 140′, around the annular groove 138′, through the check valves 143′ and directly into the cutting cone bearings 114′ by way of the distribution conduits 142′.

As long as the lubricant and air mixture is flowing under pressure to the cutting cone bearings 114′, the check valves 143′ remains open. However, once the flow of the pressurized air/lubricant mixture ceases, the check valves 143′ closes to prevent any water, mud or the like, which may seep into the space between the cutting cones 112′ and the supporting bit housing 106′, from backing up through the distribution conduits 142′ and into the adapter sub reservoir 138′ and conduit 140′.

The operation of the alternate embodiment is substantially the same as that of the above-described embodiment. Pressurized air still flows down the central conduit within the drill pipe 16′ and enters the plenum chamber 124′. Thereafter, the air is divided into only two flows (as opposed to three flows in the FIG. 5 embodiment), the first flow passing downwardly through conduit 126′ for discharge between the cutting cones 112′ and the second flow passing into port 128′ and conduit 130′ for discharge through jet nozzle assemblies 132′. Unlike the above-described preferred embodiment, there is no need to have a third flow of pressurized air from the plenum chamber 124′, since, as described above, pressurized air has already been mixed with the lubricant at the surface level.

From the foregoing description, it can be seen that the present invention provides an improved method and apparatus for lubricating drill bits of the type having a plurality of bearing-mounted rotary cutting cones. It will be recognized by those skilled in the art that changes may be made to the above-described apparatus without departing from the broad inventive concepts disclosed herein. It is understood, therefore, that this invention is not limited to the particular embodiments disclosed, but it is intended to cover all modifications which are within the scope and spirit of the invention as defined by the appended claims.

We claim:

1. An apparatus for providing a flow of lubricating fluid from a surface-mounted lubricating fluid source through a rotatable drill pipe to the rotary cutting cones of a rotary drill bit for drilling in an underground formation, comprising:

pump means for providing a flow of lubricating fluid from the lubricating fluid source to the drill pipe;

drill pipe conduit means extending along the drill pipe for receiving the flow of lubricating fluid and for directing the lubricating fluid flow to the drill bit; and distribution conduit means extending from the drill pipe conduit means to the cutting cones for receiving the flow of lubricating fluid from the drill pipe conduit means and for directing the lubricating fluid flow to the cutting cones for lubrication thereof.

2. The apparatus as recited in claim 1 wherein the pump means includes:

a lubricating fluid pump having an intake side and an output side;

first lubricant conduit means providing fluid communication between the lubricating fluid source and the intake side of the pump; and second lubricant conduit means providing fluid communication between the output side of the pump and the drill pipe conduit means.

3. The apparatus as recited in claim 2 wherein the pump means further includes control means for controlling the operation of the pump.

4. The apparatus as recited in claim 3 wherein the control means comprises a timer for cycling the pump on and off at predetermined time intervals.

5. The apparatus as recited in claim 4 wherein the timer is adjustable to vary the on and off time intervals depending upon the operating characteristics of the drill bit.

6. The apparatus as recited in claim 4 wherein the timer is adjustable to vary the on and off time intervals depending upon the characteristics of the underground formation.

7. The apparatus as recited in claim 2 further including a source of pressurized air and means for providing a flow of air from the source of pressurized air to the second lubricant conduit means.

8. The apparatus as recited in claim 1 wherein the drill pipe conduit means comprises a galley line within the drill pipe wall extending the length of the drill pipe.

9. The apparatus as recited in claim 7 wherein the drill pipe comprises a plurality of pipe sections interconnected end to end, each pipe section having a galley line within the drill pipe wall and each pipe section including check valve means at one end of the galley line to prevent the drainage of lubricating fluid therefrom when the apparatus is not operational.

10. The apparatus as recited in claim 1 wherein the drill pipe conduit means further includes oiling gland adapter means for receiving the flow of lubricating fluid from the lubricating fluid source and for directing the lubricating fluid flow along the drill pipe conduit means.

11. The apparatus as recited in claim 10 wherein the oiling gland adapter means comprises:

a generally annular adapter housing having a first axial end coupled to the drill pipe for rotation therewith;

an annular slip ring member spaced from at least a portion of the adapter housing;

means defining an annular cavity in the oiling gland adapter means, said slip ring member including means for receiving the flow of lubricating fluid and for directing the fluid into the annular cavity; and connecting means between the annular cavity and the drill pipe conduit means for directing the flow of lubricating fluid from the annular cavity to the drill pipe conduit means.

12. The apparatus as recited in claim 1 further including a source of pressurized air and means for providing a flow of pressurized air from the source of pressurized air to the drill pipe conduit means.

13. A method for providing a flow of lubricating fluid to a rotary drill bit from a surface-mounted lubricating fluid source through a rotatable drill pipe, the drill pipe having a central conduit for receiving pressurized gaseous fluid from a pressurized gaseous fluid source, the lubricating fluid being conveyed from the drill pipe to rotary cutting cones supported on an adapter subassembly drilling in an underground formation, the adapter subassembly having a plenum chamber therein for receiving gaseous fluid from the central conduit in the drill pipe, comprising:

pumping a flow of lubricating fluid from the lubricating fluid source to the drill pipe;

directing the lubricating fluid through a drill pipe conduit means separate from the central conduit, and extending along the length of the drill pipe and into conduit means provided in the adapter subassembly;

providing a passageway between the plenum chamber and the conduit means in the adapter subassembly such that gaseous fluid from the plenum chamber enters the conduit means and combines with the lubricating fluid; and directing the mixture of lubricating fluid and gaseous fluid through a distribution conduit means at the drill bit to the rotary cutting cones of the drill bit for the lubrication of the cutting cones.

14. A method for providing a flow of a lubricating mixture consisting of lubricating fluid and air from a surface-mounted lubricating fluid source through a rotatable drill pipe to rotary cutting cones of a drill bit for drilling in an underground formation, comprising:

forming the mixture of lubricating fluid and air;

pumping the mixture to an oiling gland adapter means located along the drill pipe;

directing the mixture from the oiling gland adapter into a drill pipe conduit means extending along the length of the drill pipe; and directing the mixture through a distribution conduit means at the drill bit to the rotary cutting cones for the lubrication of the cutting cones.

15. An apparatus for lubricating cutting cones of a rotary drill bit from a surface-mounted lubricating fluid source through a rotatable drill pipe, the drill pipe having a central conduit for receiving pressurized gaseous fluid from a pressurized gaseous fluid source, the drill bit being supported on an adapter subassembly drilling in an underground formation, the apparatus comprising:

a galley line within a wall of the drill pipe separate from the central conduit and extending along the drill pipe for receiving the flow of lubricating fluid;

pump means for providing a flow of lubricating fluid from the lubricating fluid source to the galley line;

a plenum chamber within the adapter subassembly for receiving pressurized gaseous fluid from the central conduit in the drill pipe;

conduit means in the adapter subassembly for receiving the flow of lubricating fluid from the galley line;

a passageway in the adapter subassembly having a flow of pressurized gaseous fluid from the plenum chamber enter the conduit means for providing a mixture of lubricating fluid and pressurized gaseous fluid in the conduit means; and distribution conduit means in the drill bit for directing the mixture of lubricating fluid and gaseous fluid to the rotary cutting cones of the drill bit for lubrication thereof.

16. The apparatus as recited in claim 15 wherein the pump means further includes control means for controlling the operation of the pump.

17. The apparatus as recited in claim 15 wherein oiling gland adapter means is provided to receive the flow of lubricating fluid from the fluid source and for directing the lubricating fluid into the galley line.

18. The apparatus as recited in claim 15 wherein the drill pipe comprises a plurality of pipe sections interconnected end to end, each pipe section having a galley line within a wall of the drill pipe and each pipe section including check valve means at one end of the galley line to prevent the drainage of lubricating fluid therefrom when the pump means is not operational.

* * * * *

UNITED STATES PATENT AND TRADEMARK OFFICE

CERTIFICATE OF CORRECTION

PATENT NO. : 4,508,183

DATED : April 2, 1985

INVENTOR(S) : Donald D. Drummond et al.

It is certified that error appears in the above-identified patent and that said Letters Patent is hereby corrected as shown below:

Column 11, line 27, delete "claim 7" and insert --claim 8--.

Signed and Sealed this

*Sixth* Day of *August 1985*

[SEAL]

*Attest:*

DONALD J. QUIGG

*Attesting Officer*

*Acting Commissioner of Patents and Trademarks*